US011396802B2

(12) United States Patent
May

(10) Patent No.: US 11,396,802 B2
(45) **Date of Patent: *Jul. 26, 2022**

(54) INTELLIGENT REAMER FOR ROTARY/SLIDING DRILLING SYSTEM AND METHOD

(71) Applicant: Mark May, The Woodlands, TX (US)

(72) Inventor: Mark May, The Woodlands, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/911,733

(22) Filed: Jun. 25, 2020

(65) Prior Publication Data

US 2020/0325762 A1 Oct. 15, 2020

Related U.S. Application Data

(60) Continuation of application No. 15/848,690, filed on Dec. 20, 2017, now Pat. No. 10,697,285, which is a division of application No. 14/505,825, filed on Oct. 3, 2014, now Pat. No. 9,879,518.

(60) Provisional application No. 61/890,218, filed on Oct. 12, 2013.

(51) Int. Cl.
*E21B 44/00* (2006.01)
*E21B 10/32* (2006.01)

(52) U.S. Cl.
CPC ..... *E21B 44/00* (2013.01); *E21B 10/32* (2013.01)

(58) Field of Classification Search
CPC ..... E21B 10/32; E21B 44/00; E21B 10/26
See application file for complete search history.

(56) References Cited

U.S. PATENT DOCUMENTS

| | | | | |
|---|---|---|---|---|
| 4,848,490 | A | 7/1989 | Anderson | |
| 5,060,736 | A | 10/1991 | Neff | |
| 5,746,278 | A | 5/1998 | Bischel et al. | |
| 6,470,977 | B1 | 10/2002 | Chen et al. | |
| 6,732,817 | B2 | 5/2004 | Dewey et al. | |
| 7,506,703 | B2 | 3/2009 | Campbell et al. | |
| 7,597,158 | B2 | 10/2009 | Campbell et al. | |
| 7,757,787 | B2 | 7/2010 | Mackay et al. | |
| 7,823,663 | B2 | 11/2010 | Eddison | |
| 8,215,418 | B2 | 7/2012 | Radford | |
| 8,235,144 | B2 | 8/2012 | Rasheed | |
| 2003/0079913 | A1 | 5/2003 | Eppink et al. | |
| 2004/0188142 | A1 | 9/2004 | Self et al. | |
| 2004/0222022 | A1 | 11/2004 | Nevlud et al. | |
| 2006/0113113 | A1 | 6/2006 | Underwood et al. | |
| 2007/0163810 | A1 | 7/2007 | Underwood et al. | |
| 2007/0187148 | A1 | 8/2007 | Self et al. | |
| 2008/0128169 | A1 | 6/2008 | Radford et al. | |
| 2009/0114448 | A1 | 5/2009 | Iaird et al. | |
| 2010/0139981 | A1 * | 6/2010 | Meister | E21B 47/022 175/61 |

(Continued)

*Primary Examiner* — Caroline N Butcher
(74) *Attorney, Agent, or Firm* — Kenneth L. Nash

(57) ABSTRACT

A downhole intelligent reamer controller detects the difference between rotary drilling and sliding drilling, responds appropriately and quickly to multiple changes between rotary drilling and sliding drilling that may occur several times each stand of pipe. Additional controls prevent deployment of reamer members at inappropriate times such as when drilling out cement, testing, and running in and out of the wellbore. In one embodiment, a separate modular control sub is disclosed that may be utilized with and/or removably secured to an expandable reamer and/or other types of downhole tools.

10 Claims, 9 Drawing Sheets

(56) References Cited

U.S. PATENT DOCUMENTS

| | | | | |
|---|---|---|---|---|
| 2010/0282511 | A1 | 11/2010 | Maranuk et al. | |
| 2011/0127044 | A1 | 6/2011 | Radford et al. | |
| 2011/0284233 | A1 | 11/2011 | Wu et al. | |
| 2012/0031673 | A1* | 2/2012 | MacKenzie | E21B 10/322 175/57 |
| 2012/0080228 | A1* | 4/2012 | Radford | E21B 21/08 175/45 |
| 2013/0292175 | A1* | 11/2013 | Radford | E21B 10/32 175/24 |
| 2013/0306373 | A1 | 11/2013 | Rasheed | |
| 2014/0262508 | A1 | 9/2014 | Fuller et al. | |
| 2014/0262525 | A1 | 9/2014 | Fuller et al. | |

* cited by examiner

Top View

Additional Tools for Use with Control Sub

INTELLIGENT REAMER FOR ROTARY/SLIDING DRILLING SYSTEM AND METHOD

BACKGROUND OF THE INVENTION

Field of the Invention

The present invention relates generally to borehole reamers to enlarge the size of drilled borehole and, more particularly in some non-limiting embodiments, to a downhole intelligent reamer controller that can detect the difference between rotary drilling and sliding drilling, respond appropriately and quickly to multiple changes between rotary drilling and sliding drilling that may occur several times each stand of pipe, with additional controls to prevent deployment of reamer members at inappropriate times such as when drilling out cement, testing, and running in and out of the wellbore.

Background of the Invention

Expandable reamers or underreamers are well known in the oilfield drilling industry. The term reamer and underreamer is used herein interchangeably although often a reamer is considered to be a fixed blade device that may be the same or approximately the same size as the bit size.

It is often desirable to increase the annular space in a wellbore for various reasons. Typical reasons may be to provide additional annular space for cementing, increased production flow area, to allow for increased casing size, to clean the hole where swelling occurs, increase annular space to avoid surge pressures when running a liner, Equivalent Circulating Density (ECD) problems, swelling shales, creeping salts, sloughing/cave-ins, casing exits and the like.

An expandable reamer may typically have two basic operative states. In one state, the reamer member or members are closed or in a collapsed state where the diameter of the reamer tool is smaller, for example, sufficiently small to allow the tool to pass through existing open or cased borehole. In the second state, an open or partly expanded state is provided, where one or more reamer members with cutters on the end (cutter blocks) thereof extend from the body of the tool. In the expanded state, the reamer enlarges the borehole diameter as the tool is rotated and lowered and/or raised in the borehole. The reamer or underreamer typically operates during rotation of the drill string and is typically actuated by drilling fluid flow.

In some types of drilling operations, such as certain types of directional drilling operations, both rotating drilling and sliding drilling is utilized when the drive mechanism for the drill bit is either a Positive Displacement Mud Motor (Mud Motor), or a Downhole Turbine (Turbine). The mud motor and the turbine have similar components, which are the Power Section, Transmission Bent Housing Section and Bearing Stabilizer Section. The Power Section is comprised of a Rotor and Stator, whereby the rotor is turned by the pressure drop across either the cavities in the mud motor, or across the turbine stages in the turbine, which turns the bit. The Transmission Bent Housing Section contains couplings inside that eliminate all eccentric rotor motion and accommodate the misalignment of the bent housing, while transmitting torque and down thrust to the drive shaft. The Bearing Stabilizer Section contains the Bearing Assembly, comprised of multiple thrust-bearing cartridges, radial bearings, a flow restrictor, and a drive shaft. The housing of the Bearing Assembly can have a threaded O.D. to accommodate a thread on stabilizer sleeve. If no stabilization is required, a non-threaded version slick housing can be used. The drive shaft has standard drilling thread connections to connect the motor to the drill bit. For the sake of simplicity, the term for the drive mechanism used herein is a mud motor.

A mud motor is utilized during sliding drilling—when the drill string is substantially non-rotating and the bend is oriented in the desired direction to guide the trajectory of the borehole toward the target location.

As part of the rotating/sliding directional steering process with a mud motor, the drill string is often frequently changed between rotating drilling and sliding drilling. Sliding drilling creates an initial deviation arc, which is then followed by rotating drilling to provide directional control. For example, both sliding and rotating drilling may alternately be used several different times while drilling each stand of drill pipe, wherein a stand of drill pipe may comprise of two or more pipes connected together. Due to frequently alternating changes in types of drilling, prior art expandable reamers have significant disadvantages when used for rotating/sliding directional steering operations making them unsuitable, slow to open and close, and/or incapable for this purpose.

Many expandable reamers expand in response to pumping drilling fluid at a certain rate or pressure. However, due to the need for pumping drilling fluid during the sliding directional drilling, if the reamer expands due solely to drilling fluid flow this can be very problematic. In most cases, expandable reamers are designed to remain closed until a ball, dart, RFID Tag, or other object is dropped, or pumped, down the Internal Diameter (ID) of the drill string to initially expand the tool. For the sake of simplicity, the term for the object dropped herein is a ball. The time required for the ball to reach the reamer results in significant lost rig time, making this type of expandable reamer unsuitable for rotating/sliding drilling operations with mud motors. Even if this type of device can be repeatedly closed for sliding drilling, which is not normally the case, this type of activation is not well suited to switching quickly between sliding drilling and rotary drilling. Dropping balls to close the reamer for sliding drilling is not realistically practical due to extensive lost rig time.

Mechanical and/or Hydraulic systems that respond to variations to drilling fluid flow or pressure, whereby the nominal flow rate is reduced temporarily, can be utilized to expand or close the tool multiple times are available, without the need to drop a ball. However, the variations in fluid flow or pressure, which is required to expand or retract the reamer members are time consuming to operate when switching frequently between rotary drilling and sliding drilling. Reducing the flow rate may also adversely affect the performance of the drive system. In addition, repeated flow reductions will significantly increase time lost due to switching and may be prone to both personnel and mechanical operation errors with frequent switching.

Recent art utilizing electronic systems may require frequent down link commands. Down link commands can be described as manual alterations to the rig pump and/or rotary speed settings in a specific sequence. Down link commands can also be transmitted using a controlled valve that shunts a portion of the drilling fluid going to the standpipe, back to the active mud tank. Down linking transmits encoded instructions to the downhole electronics to either open or close the underreamer when switching frequently between rotary drilling and sliding drilling. Repeated downlinking; however, result in significant time lost in switching the reamer members between an expanded or retracted.

Examples of background patents and publications in the general area of expandable reamers include:

US Publication NO 2013/0306,373 discloses an electronically activated tool comprising a tool body, cutter blocks and sensors with means for attachment to a drilling support and rotation so as to permit the simultaneous underreaming and measurement of the diameter of a wellbore (especially in oil and gas drilling) characterized by a means of activation using an electronic signal sent by mud-pulse, fiber-optics, wireless transmission or other means which may also communicate commands and receive data from the underreamer during drilling, at least one radially extendable cutter block incorporating positional sensors adapted to measure the relative position of the cutter block to the tool, at least one caliper means to measure wellbore diameter, all of which are inter-linked by a means of communication using receivers, sensors and microprocessors.

US Publication No 20100282511 discloses a wired reamer for use on a downhole drill string. In some embodiments, the reamer includes a reamer body comprising a pathway therethrough and wiring located within the pathway for transmitting at least one of power or communications. In other embodiments, the reamer includes a reamer body comprising a pathway enclosed within the reamer body, wiring located within the pathway for transmitting at least one of power or communications, a sensor and a processor located within the reamer body. The sensor is connected with the wiring for transmitting data measured by the sensor through the wiring, and the processor is connected with the wiring for receiving the data from the sensor.

U.S. Pat. No. 8,235,144 discloses an expansion and sensing tool comprising a tool body, cutter blocks and sensors which permit simultaneous underreaming and measurement of the diameter of a wellbore drilled by an oil and gas rig. Radially extendable cutter blocks incorporating positional sensors contained on the block or within the body measure the position of the cutter block relative to the tool, and a vibration sensor measures vibration and underreaming wellbore dimensions in real-time. Receivers, sensors and microprocessors deliver a desired wellbore depth both simultaneously comparing and correlating measured vibration data and underreaming parameters. The tool may be optionally configured with a caliper or a stabilizer.

US Publication No. 20110284233 discloses a downhole tool assembly configured for repeated and selective hydraulic actuation and deactivation. A piston assembly is configured to reciprocate axially in a downhole tool body. The piston assembly reciprocates between a first axial position and second and third axial positions that axially oppose the first position. The downhole tool is actuated when the piston assembly is in the third axial position and deactivated when the piston assembly is in either of the first or second axial positions. A spring member biases the piston assembly towards the first axial position while drilling fluid pressure in the tool body urges the piston assembly towards the second and third axial positions. Downhole tool actuation and deactivation may be controlled from the surface, for example, via cycling the drilling fluid flow rate.

U.S. Pat. No. 5,060,736 discloses a bottom hole assembly having a bit driven by a downhole motor and stabilizers located above the motor on the drill string. A subassembly is also provided for controlling the bit trajectory that is operational on demand at the rig site. The subassembly comprises an underreamer located directly above the bit. The underreamer is hydraulically actuated to retract and extend the cutters.

U.S. Pat. Nos. 7,506,703 and 7,597,158 disclose an expandable drilling apparatus deployed upon a distal end of a drillstring and includes a cutting head and a substantially tubular main body adjacent the cutting head providing a plurality of axial recesses configured to receive arm assemblies configured to translate between a retracted and an extended position. A flow switch actuates the arm assemblies when a drilling fluid pressure exceeds an activation value and the drilling apparatus includes a biasing member to reset the arm assemblies when the drilling fluid pressure falls below a reset value.

U.S. Pat. No. 5,746,278 discloses an apparatus and method for controlling an underground boring machine during boring or reaming operations. A boring tool is displaced along an underground path while being rotated at a selected rate of rotation. In response to variations in underground conditions impacting boring tool progress along the underground path, a control system concurrently modifies the rate of boring tool displacement along the underground path while rotating the boring tool at the selected rotation rate. The controller monitors the rate at which liquid is pumped through the borehole and automatically adjusts the rate of displacement and/or the liquid flow rate so that sufficient liquid is flowing through the borehole to remove the cuttings and debris generated by the boring tool. Sensors are provided to sense pressure levels in the rotation, displacement, and liquid dispensing pumps and an electronic controller continuously monitors the levels detected by the sensors. When the controller detects a rise in rotation pump pressure above an unacceptable level, the controller disengages the boring tool by reducing the rate of boring tool displacement along the underground path, while maintaining rotation of the boring tool at a pre-selected rate. Such disengagement reduces the load on the rotation pump and allows the pressures to recover to an acceptable level. The controller re-engages the boring tool after detecting that the rotation pump pressure has fallen below a set level.

U.S. Pat. No. 7,823,663 discloses a downhole apparatus that comprises a body, extendable members mounted on the body and being movable between retracted and extended configurations, and a remotely operable retaining arrangement for maintaining the extendable members in the retracted configuration. The extendable members may be cutters, such that the apparatus may be a cutting apparatus, such as a reamer. An operator may control the apparatus to retain the cutting members in the retracted configuration, or prevent the extension of the cutting members.

U.S. Pat. No. 8,215,418 discloses an expandable reamer apparatus and methods for reaming a borehole, wherein a laterally movable blade carried by a tubular body may be selectively positioned at an inward position and an expanded position. The laterally movable blade, held inwardly by blade-biasing elements, may be forced outwardly by drilling fluid selectively allowed to communicate therewith by way of an actuation sleeve disposed within the tubular body. Alternatively, a separation element may transmit force or pressure from the drilling fluid to the movable blade. Further, a chamber in communication with the movable blade may be pressurized by way of a downhole turbine or pump. A ridged seal wiper, compensator, movable bearing pad, fixed bearing pad preceding the movable blade, or adjustable spacer element to alter expanded blade position may be included within the expandable reamer. In addition, a drilling fluid pressure response indicating an operational characteristic of the expandable reamer may be generated.

U.S. Pat. No. 6,470,977 discloses a steerable bottom hole assembly used for drilling both a curved section and straight section of the borehole, with the bottom hole assembly including a reamer beneath the downhole motor. The bottom hole assembly includes a bit having a bit face defining a bit diameter, and a gauge section having a substantially uniform diameter cylindrical surface approximating the bit diameter and having an axially length of at least 75% of the bit diameter. The motor is preferably run slick without stabilizers for engaging the wall of the borehole.

U.S. Pat. No. 6,732,817 discloses a downhole tool that functions as an underreamer, or alternatively, as a stabilizer in an underreamed borehole. The tool includes one or more moveable arms disposed within a body having a flow bore therethrough in fluid communication with the wellbore annulus. The tool alternates between collapsed and expanded positions in response to differential fluid pressure between the flow bore and the wellbore annulus. In one embodiment, the tool moves automatically in response to differential pressure. In a second embodiment, the tool must be selectively actuated before it is moveable. When the tool expands, the arms are preferably translated axially upwardly, while simultaneously being extended radially outwardly from the body. The expanded tool diameter is adjustable at the surface without changing components. The arms may include borehole engaging pads that comprise cutting structures or wear structures or both, depending upon the function of the tool.

US Publication 20040188142 discloses a horizontal directional drilling system used to drive operation of a guidable reamer assembly connected to a drill string. The guidable reamer assembly preferably has a cutting member with a central longitudinal axis and a support member also having a central longitudinal axis. The longitudinal axes of the cutting member and the support member are collinear when the reamer assembly is in the non-steering position and laterally displaced when in the steering position.

U.S. Pat. No. 4,848,490 discloses a directional downhole stabilizer for use in a drill string. The stabilizer has an effective diameter which is selectively variable between a minimum diameter and a maximum diameter depending on the load on the drill string. The effective diameter is determined by radially movable spacers which are caused to move radially on relative movement of a mandrel which telescopes within the stabilizer casing and which has cam surfaces which engage the radial spacers. The telescopic movement of the mandrel within the casing is controlled via a mechanical detect arrangement which is actuated by the compressive force on the stabilizer.

U.S. Pat. No. 7,757,787 discloses an expandable drilling apparatus that includes a main body comprising a central bore and at least one axial recess configured to receive an arm assembly operable between a retracted position and an extended position, a biasing member to urge the arm assembly into the retracted position, a drive position configured to thrust the arm assembly into the extended position when in communication with drilling fluids in the central bore, a selector piston translatable between an open position and a closed position, wherein the selector piston is thrust into the open position when a pressure of the drilling fluids exceeds an activation value, wherein the drilling fluids are in communication with the drive piston when the selector piston is in the open position, and a selector spring configured to thrust the selector piston into the closed position when the pressure of the drilling fluids falls below a reset value.

US Publication 20060113113 discloses a bottomhole assembly that includes a drill bit, a stabilized underreamer assembly located behind the drill bit, and a drilling assembly. A method to drill a formation includes positioning a stabilized underreamer assembly behind a drill bit, positioning a drilling assembly behind the stabilized underreamer assembly, and rotating the drill bit and stabilized underreamer assembly with the drilling assembly. A stabilized underreamer located between a directional drilling assembly and a drill bit includes at least one arm assembly extending from the stabilized underreamer assembly, wherein the arm assembly includes a stabilizer portion and an underreamer cutting structure.

US Publication No 20070163810 discloses a bottom hole assembly to directionally drill a subterranean formation includes a drill bit, a stabilizer assembly located proximate to and behind the drill bit, a drilling assembly comprising a drive mechanism and a directional mechanism, and a flex member. Optionally, the flex member may be located between the drilling assembly and the stabilizer assembly or an integral to a housing of the drilling assembly. A method to drill a formation includes positioning a stabilizer assembly behind a drill bit and positioning a flex member between an output shaft of a drilling assembly and the stabilizer assembly. The method preferably includes rotating the drill bit, stabilizer assembly, and flex member with a drilling assembly and directing the trajectory of the drill bit and stabilizer assembly with a directional mechanism of the drilling assembly.

US Publication No 20100139981 discloses A bottomhole assembly (BHA) coupled to a drill string includes one or more controllers, and a hole enlargement device that selectively enlarges the diameter of the wellbore formed by the drill bit. The hole enlargement device includes an actuation unit that may move extendable cutting elements of the hole enlargement device between a radially extended position and a radially retracted position. The actuation unit may be responsive to a signal that is transmitted from a downhole and/or a surface location. The hole enlargement device may also include one or more position sensors that transmit a position signal indicative of a radial position of the cutting elements. In an illustrative operating mode, one or more operating parameters of the hole enlargement device may be adjusted based on one or more measured parameters. This adjustment may be done in a closed-loop or automated fashion and/or by human personnel.

The above publications and patents are hereby incorporated herein by reference.

Accordingly, there exists a need for an intelligent downhole controller, which addresses the problems described hereinbefore. Consequently, those skilled in the art will appreciate the present invention that addresses the above and other problems.

SUMMARY OF THE INVENTION

An object of the present invention is to provide an improved reamer.

Another possible object of the present invention is to provide an improved reamer that is especially useful when frequently changing between sliding drilling and rotating drilling, when the drive mechanism is a Mud Motor.

Another possible object is to provide an intelligent reamer that can distinguish rotary drilling from sliding drilling and respond quickly without opening at inopportune times.

Another possible object of the present invention is to provide an intelligent reamer that not only distinguishes between rotating drilling and sliding drilling but distinguishes the occasional rotation such as drill string windup (reactive torque), mud motor stalling, slip stick or bit whirl that may occur sliding operations.

A further possible object of the present invention is to provide an intelligent reamer that has built in safeguards that prevent undesirable deployment of reamers such as with drilling out cement in casing, float equipment and casing shoe, pressure testing (leak-off test), or other situations when reaming is not desired.

Another possible object of the present invention is to provide an intelligent automated reamer that significantly and more reliably improves drilling speed for rotating/sliding drilling operations that require reaming while also improving borehole quality such as size consistency, angle change smoothness and smoothing of ledges and doglegs.

These and other objects, features, and advantages of the present invention will become clear from the figures and description given hereinafter. It is understood that the objects listed above are not all inclusive, are non-limiting, and are only intended to aid in understanding the present invention, and do not limit the bounds of the present invention in any way.

Accordingly, the present invention, in one possible non-limiting embodiment comprises an intelligent reamer, which may comprise a reamer body section, reamer members such as but not limited to cutter blocks mounted to the reamer body section for selective movement between a radially inwardly position and a radially extended position from the reamer body section. An opening and closing mechanism is operatively connected to the reamer members to move the reamer members between a radially inwardly position and the radially extended position such as an actuator that is activated by the electronic control unit. The actuator, which may be hydraulic, mechanical, and/or electrical or a combination thereof, can be mounted in the reamer body or in a separate control sub (Modular Control Sub), is utilized for controlling the reamer members. The actuator is operably connected to the electronic control unit, which regulates the operation of the intelligent reamer.

Other possible elements of the electronic control unit may be comprised of, but not limited to, a processor, a power supply, a temperature sensor, a memory board, and a digital signal processor (DSP). The electronic control unit is operably connected to the rotation sensor(s) and the fluid operation sensor(s). In one possible embodiment, the rotation sensor comprises at least one of an accelerometer, a magnetometer, or other sensor readings that indicate whether the tool is being rotated. In another possible embodiment, the fluid flow or fluid operation sensor may comprise an internal pipe pressure sensor. In another embodiment, the fluid operation sensor comprises at least one of a pressure sensor, a flow switch or a fluid flow sensor. An annular pressure sensor can be connected to the electronic control unit to monitor annular pressures.

In one non-limiting example, the electronic control unit is operable for placement of the intelligent reamer into a sleep mode and an operate mode.

In the sleep mode, the electronic control unit, in one possible embodiment, will always keep the reamer members in the radially inwardly position. In the active mode, the electronic control unit is operable to move the reamer members to the radially extended position only when the fluid operation sensor indicates at least a selected amount of drilling fluid flow and the rotation sensor indicates at least a selected amount and/or test for desired clockwise rotation. In one embodiment, the selected amount of rotation comprises a selected speed of rotation for a selected period of time, e.g., at least 10 RPM in a clockwise direction and/or relatively constant rotational speeds in the clockwise direction for at least 5 seconds.

In one possible embodiment, the electronic control unit is responsive to the fluid operation sensor for the placement from the sleep mode into the active mode, by the cycling of the surface mud pumps (down linking) whereby the surface mud pumps or controls thereof effectively comprise a surface control for the down hole tool. The electronic control unit may be designed to be responsive to one or more selected patterns of drilling fluid flow detected by the fluid operation sensor and/or rotation sequences or other movement patterns detected by the rotation sensors, motion sensors (down link) or the like, for the placement of the tool into the sleep mode or into the active mode.

The intelligent reamer, in one embodiment, may be comprised of an electronic control unit, sensors and actuators that may be mounted in an electronic control housing, directly to the reamer body section, in a modified reamer housing, or the like wherein a common housing is utilized for the electronic control housing and the reamer. In a second embodiment some, or all, of the electronic control unit, sensors and actuators may be mounted in a separate modular control sub, which is selectively attached to the reamer body section by standard drilling thread connections.

The modular control sub could also be utilized for operating other tools besides the reamer, such as a family of downhole tools. As a non-limiting example, the modular control sub could be selectively mountable to and operable for controlling at least one of a multiple diameter casing cutter, an extendable stabilizer, a drilling circulating sub, and a sidewall coring tool.

In a non-limiting embodiment, in the sleep mode, the electronic control unit always keeps the reamer members in the radially inwardly position. In one possible embodiment, in the active mode the electronic control unit is operable to move the reamer members between a radially inwardly position and a radially extended position. For example, the electronic control unit in the active mode may move the reamer members to a selected radially outward position during rotary drilling and may move the reamer members to a closed during sliding drilling.

Other method for making steps may comprise providing one or more rotation sensor(s), providing a fluid operation sensor, and operably connecting an electronic control unit to the rotation sensor and the fluid operation sensor as discussed hereinafter.

Other method for making steps may comprise placement of the electronic control unit into a sleep mode or second mode—and an active mode or first mode, as discussed hereinafter. Modes may be referred to herein as first and second modes or the like; however, the electronic control unit can be programmed to multiple modes.

As one non-limiting example, the method may provide that in the second mode (sleep mode) the electronic control unit always keeps the reamer members in the radially inwardly position. Other non-limiting examples of method for making and/or operating steps may comprise providing that in the first mode (active mode), the electronic control unit is operable to move the reamer members to the radially extended position only when the fluid operation sensor indicates at least a selected amount of fluid operation and the rotation sensor indicates at least a minimum threshold of rotation in a clockwise direction.

The method for making and/or operating may further comprise providing that the electronic control unit is responsive to the fluid operation sensor for the placement into the active mode. For example, the method may further comprise providing that the electronic control unit is responsive to one or more selected patterns of fluid operation detected by the fluid operation sensor, as well as one or more selected rotation sequences detected by the rotation sensors(s) (down linking) for placement of the electronic control unit into the sleep mode and into the first mode (active mode).

The method for making steps may further comprise that the fluid operation sensor comprises an internal drill pipe pressure sensor. The method may further comprise providing that the fluid operation sensor comprises at least one of a pressure sensor or a flow sensor, Method steps may further comprise providing that the selected amount of rotation comprises a selected speed of rotation for a selected period of time.

In yet another possible non-limiting embodiment, a method for making an electronic reamer may comprise providing a reamer body section, mounting reamer members to the reamer body section for selective movement between a radially inwardly position and a radially extended position from the reamer body section, and providing an opening and closing mechanism operatively connected to the reamer members to move the reamer members between the radially inwardly position and the radially extended position.

Yet another possible object of the present invention is to provide a modular control sub that can control not only a separately mounted reamer body but can also be utilized to control other types of equipment, reducing the need to build a control section for different types of tools and reducing the costs for building the other types of equipment.

Method steps may further comprise providing a modular control sub, mounting the electronic control unit in the separate modular control sub, and providing that the modular control sub is selectively mountable to the reamer body section.

In one possible non-limiting example, the method for making and/or operating may further comprise providing that the modular control sub is also selectively mountable to a separate housing for controlling at least one of a multiple diameter casing cutter, an extendable stabilizer, a drilling circulating sub (to bypass lost circulation material to the annulus) and a sidewall coring tool.

A rotation sensor(s) can be operably connected to or part of the electronic control unit, whereby the electronic control unit is operable to move the reamer members to the retracted position when a rotating test detects low—or no rotation, e.g. a non-limiting test, if rotation is less than the programmed threshold speed of rotation for a selected period of time, the processor in the electronic control unit will assume slide drilling and retract the reamer members.

In one possible embodiment, the electronic control unit is responsive to a pattern of fluid operation for placing the electronic control unit in the first mode (active mode) and/or is responsive to a pattern of fluid operation and/or rotation and/or a combination for placing the electronic control unit in the second mode (sleep mode), for example a series of pressure vs. time or changes in rotary speeds vs. time.

In a non-limiting example, the electronic control unit, the rotation sensor(s), a fluid operation sensor(s) are selectively mountable directly to the reamer body. The battery powered electronic control unit can be mounted in the annular side of the reamer body section. An actuator, which may be hydraulic, mechanical, and/or electrical or a combination thereof, is mounted in the reamer body and is utilized for controlling the reamer members.

In yet another non-limiting example, an electronic control housing for use in a borehole, may comprise a battery and/or capacitor powered electronic control unit connected to a rotation sensor, a fluid operation sensor and actuator(s). The electronic control housing may be mounted in a separate control sub or in a reamer body or may be a housing that comprises reamer members. The battery powered electronic control housing is operable for controlling movement of the reamer members between the expanded position and the retracted position with an actuator.

In another non-limiting example, the electronic control unit, the rotation sensor(s), a fluid operation sensor(s) are selectively mountable to a separate a tubular body, identified heretofore as the Modular Control Sub. The modular control sub is selectively mountable to the reamer body by standard drilling thread connections. The reamer body section defines a fluid flow path therethrough to the annular space. The battery powered electronic control unit can be mounted in the annular side of the modular control sub. An actuator, which is utilized for controlling the reamer members, can be mounted in the reamer body section or in the modular control sub.

In one embodiment, the modular control sub can be mounted to and used to control a plurality of other tools such as, for example, a multiple diameter casing cutter, an extendable stabilizer, a drilling circulating sub (to bypass lost circulation material to the annulus), and a sidewall coring tool.

In this embodiment, the reamer may comprise reamer members that are moveable from a closed position to an open position. In the open position, the reamer is operable for reaming the drill string to enlarge the well bore to a diameter larger than the bit outer diameter. The electronic control unit is operable to operate the reamer for moving the reamer members between the open position and the closed position.

Operating method steps may comprise placing the electronic control unit in a sleep mode whereby the reamer members remain in the closed position. Operating method steps may further comprise running the electronic reamer into the well bore in second mode (sleep mode), until the float collar/casing shoe has been drilled out, the pressure (leak-off) tests have been performed—and sufficient open hole has been drilled, in order to allow the reamer members to extend in open hole. When the reamer is in open hole the electronic reamer control can be placed in the first mode (active mode), utilizing surface positioned fluid operation and/or rotation controls (down linking). When the electronic reamer is in the first mode (active mode) and the electronic control unit detects sliding drilling under the appropriate circumstances, the electronic control unit operates the reamer to move the reamer members to the closed position. When the electronic control unit detects rotating drilling, the electronic control unit operates the reamer to move the reamer members to the open position to enlarge the well bore.

In one embodiment, the electronic control unit distinguishes between rotating drilling and sliding drilling utilizing a mode control, by analyzing inputs from at least two different types of sensors. Processing circuitry, logic circuitry, and/or the like in the electronic control unit may be utilized to process the sensor information for distinguishing sliding drilling from rotating drilling and taking the appropriate action.

The method may further comprise placing the electronic control unit in the sleep mode utilizing surface positioned fluid operation and/or rotation controls (down linking), whereby the reamer members remain in the closed position.

In yet another non-limiting embodiment, a method of making a reamer control for use in reaming a well bore may comprise providing an electronic control unit that is operable for moving reamer members between an open position for enlarging the well bore and a closed position, providing the electronic control unit with a plurality of different types of sensors whereby the electronic control unit is operable for distinguishing between rotating drilling and sliding drilling and is further operable for moving the reamer members to the open position during the rotating drilling and for moving the reamer members to the closed position during the sliding drilling.

The method may further comprise providing, such as programming the electronic control unit with a second mode (sleep mode) whereby the reamer control maintains the reamer members in the closed position regardless of rotating drilling or sliding drilling, which may be utilized to avoid unintended reamer action, such as tripping in and out of the hole.

The method may further comprise providing the electronic control unit with an first mode (active mode) whereby the electronic control unit is operable for distinguishing between rotating drilling and sliding drilling and is further operable for moving the reamer members to the open position during the rotating drilling and for moving the reamer members to the closed position during the sliding drilling. In the active mode, the opening and closing movement of the reamer members is automatic (an unlimited number of times), without any further intervention from surface down links.

The method may further comprise providing that the electronic control unit is selectively controllable to repeatedly change (an unlimited number of times) between the second mode (sleep mode) and the first mode (active mode) using a downlink which may comprise surface positioned fluid control and/or a surface positioned drill string motion control and/or a surface positioned telemetry system.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENT

Figure 1:
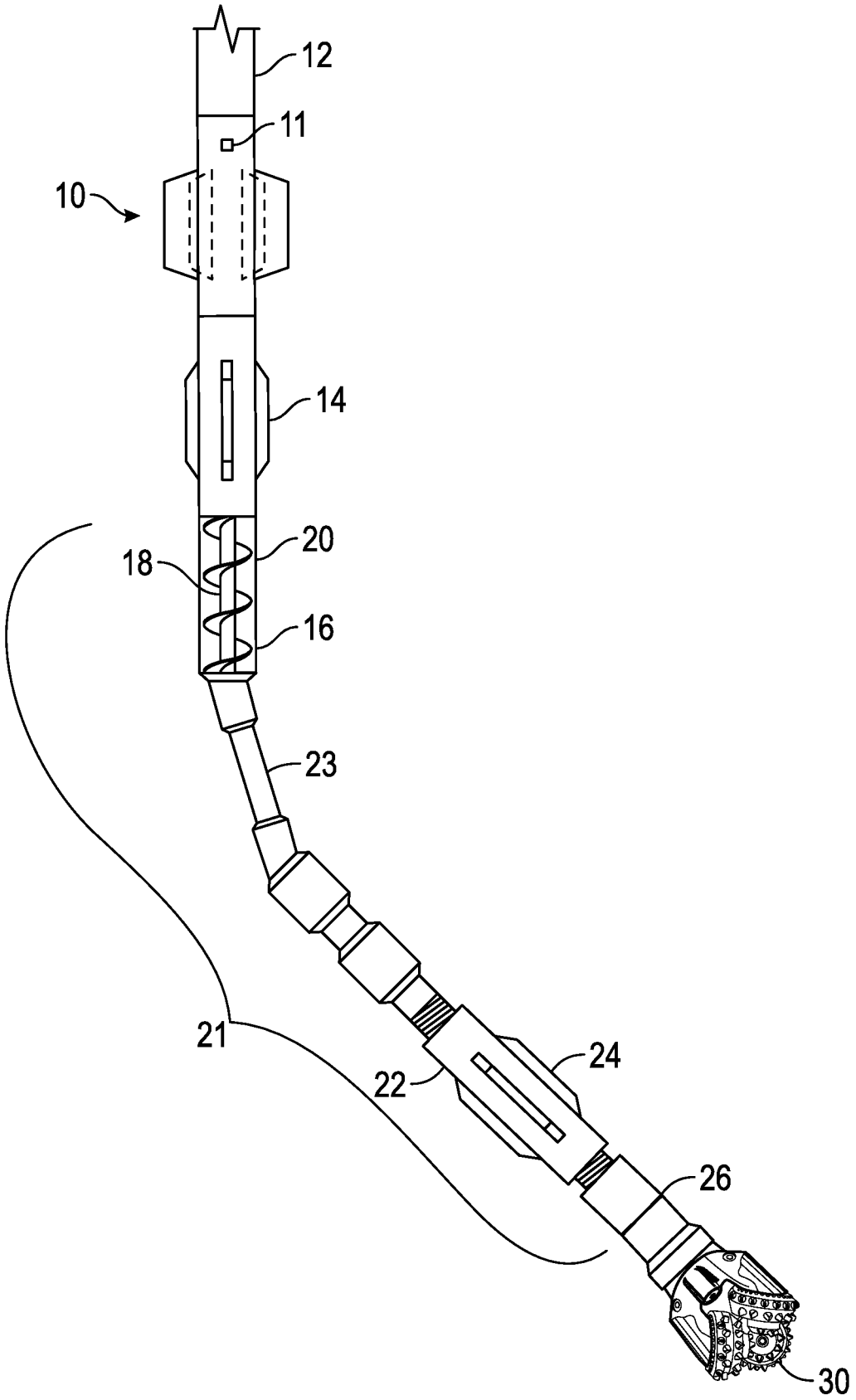
FIG. 1 is a schematic elevational diagram of a bottom hole assembly with a mud motor, for use in a sliding/rotating drilling operation in accord with one possible non-limiting embodiment of the present invention.

Turning now to the drawings, and more particularly FIG. 1, there is depicted a schematic elevational view of a downhole bottom hole assembly in accord with one possible non-limiting embodiment of the present invention.

In general overview of the drawings, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include highly simplified conceptual views and exaggerated angles, sizes, and the like, as desired for easier and quicker understanding or explanation of the invention. One of skill in the art upon reviewing this specification will understand that the relative size, orientation, angular connection, and shape of the components may be greatly different from that shown to provide illuminating instruction in accord with the novel principals taught herein. As well, connectors, component shapes, and the like, between various housings and the like may be oriented or shaped differently or be of different types as desired.

The arrangements, order of connection, and configuration of components including but not limited to stabilizers, reamer, and the like may be changed from those shown in the drawings. In the embodiment of FIG. 1, heavy weight tubulars 12 are secured to an electronically controlled expandable retractable reamer 10 in accord with the intelligent control unit of the present invention, as discussed hereinafter. Actuators 11, which may be of many types some of which are discussed herein, are operable to move the reamers between an extended position in response to control signals from the intelligent control unit.

During rotation drilling, the entire drill string including the heavy weight tubulars 12 are rotated. If desired, additional heavy weight tubulars may be positioned below the electronic reamer section 10. An MWD System (not shown) is normally positioned above the mud motor assembly 21 and the stabilizer section 14. The mud motor may be connected thereto and located there below. The power section 16 may typically comprise a rotor 18 and a stator 20. The mud motor 21 can be utilized to rotate the bit 30 without rotation of the drillstring. However, the present invention is not limited to any type of mud motor, turbine, displacement motor, or the like.

The electronic reamer 10 can be located closer to the bit, e.g. immediately above the mud motor or even directly above the bit, if desired. In this embodiment the Transmission Bent Housing Section 23 is attached below the Power Section 16. A Bearing Stabilizer Section 22, shown with optional stabilizer 24 mounted thereto may be utilized above the bit box 26 of the drive shaft. The bit box 26 has a standard drilling thread connection to connect the motor to the drill bit 30. In one embodiment, components such as the bit 30, the lower stabilizer 24, and the upper stabilizer 14 may comprise a three point contact; which in conjunction with the setting of the bend in the bent housing, determines the buildup rate for mud motor. During rotary drilling, the bit 30 is turned both by rotating the drill pipe on surface and by operation of the mud motor. During slide drilling, the bit 30 is turned solely by the operation of the mud motor. In this embodiment, electronic reamer 10 may comprise a single housing for the reamer body, reamer members, electronic control unit, sensor(s) and actuator(s). In other embodiments discussed hereinafter, a separate modular control sub that houses the electronic control unit, sensor(s) and actuator(s) is utilized with a separate reamer body with reamer members. Accordingly, the electronic control unit may be mounted in the same housing as the reamers or in a separate housing as discussed in more detail herein.

Figure 2:
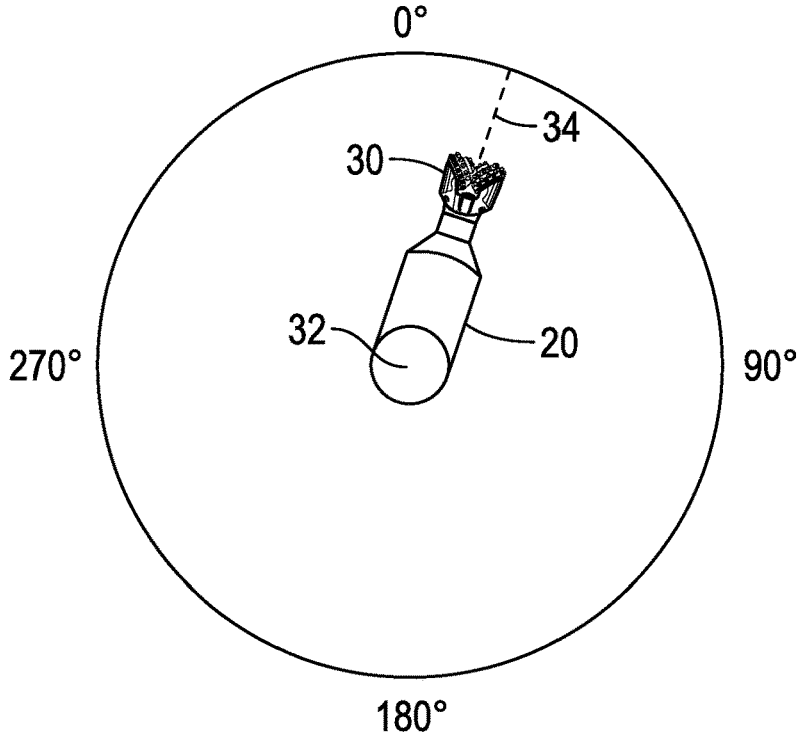
FIG. 2 is a schematic top view of a directional drilling assembly for orientation in a desired direction in accord with one possible non-limiting embodiment of the present invention.

FIG. 2 shows a top view of a directional sliding tool being oriented. Due to flexibility of the drill string 32 and the reactive torque of the mud motor, the drill pipe may need to be rotated several times at the surface, in order to properly orient the mud motor in the desired direction 34. After rotating drilling, the drill pipe may need to be reoriented to point the bend in the bent housing of the mud motor, in the planned direction of the trajectory of the wellbore so as to follow a desired path to a predetermined target.

Figure 3:
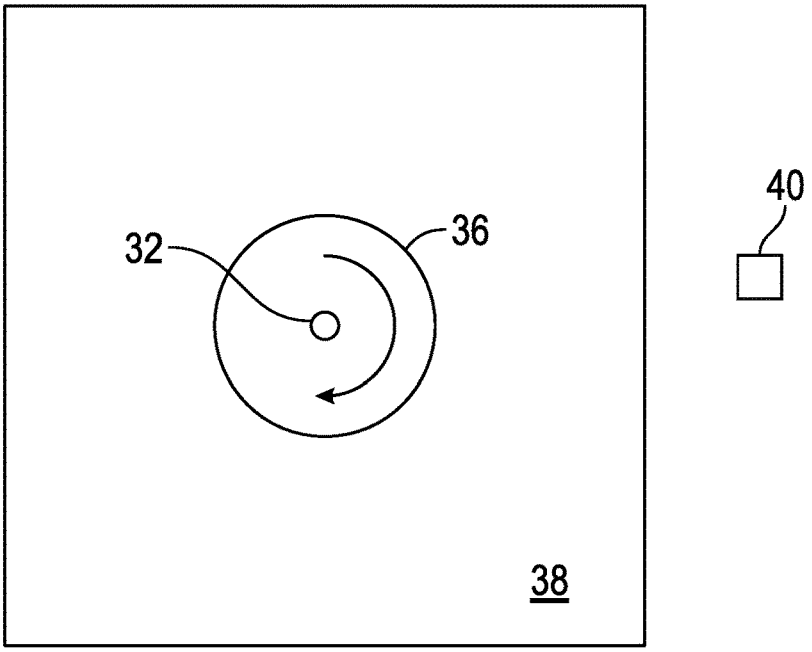
FIG. 3 is a schematic top view of relevant drilling rig components such as a rotary table for rotating a drilling string which may be used for directional drilling in accord with one possible non-limiting embodiment of the present invention.

FIG. 3 shows a top view of a rotary table 36 for rotating drill pipe on the rig floor 38 of a drilling rig. A top drive (not shown) may also be utilized to rotate the drill string 32. A mud pump 40 may be utilized for pumping fluid through the drilling string. As discussed hereinafter, the mud pump 40 may also be utilized as one of the mode controllers which are utilized to change the mode in a processor in an electronic reamer control (down link) between a sleep mode and an active mode in accord with one embodiment of the invention.

Figure 4:
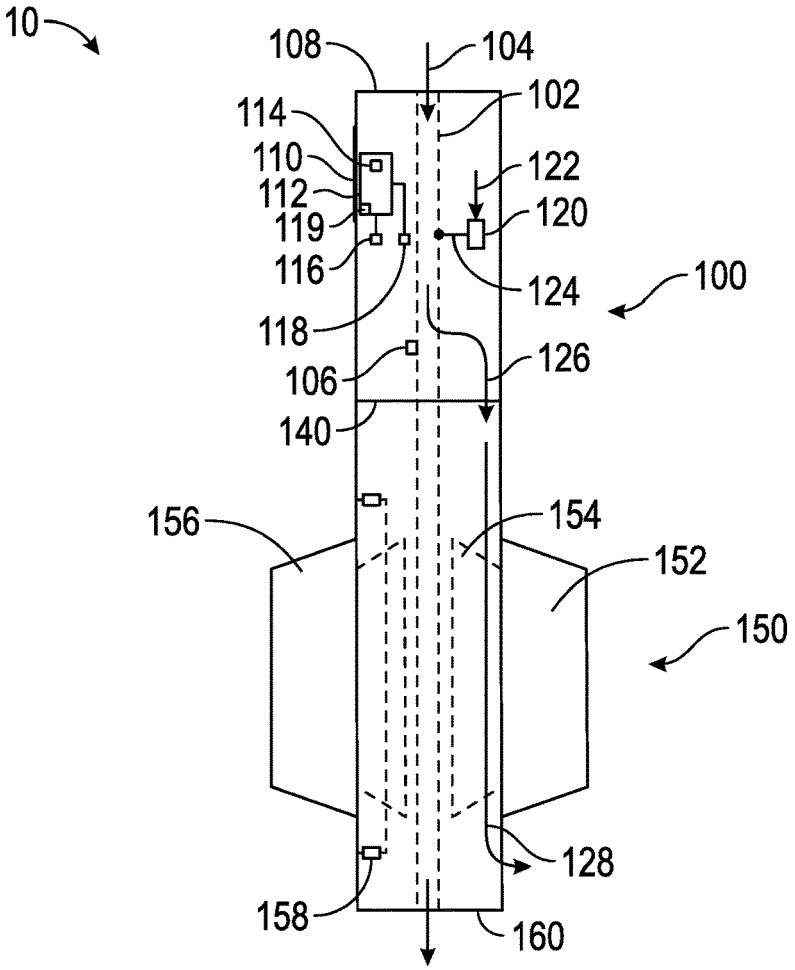
FIG. 4 is a schematic elevational view of one possible embodiment of an electronic control unit, sensor(s) and actuator(s) housed in a modular control sub, which is attached to a separate but controllable reamer body by standard drilling thread connections, in accord with one possible non-limiting embodiment of the present invention.

FIG. 4 shows one possible non-limiting embodiment of a separate modular control sub 100 in accord with one possible embodiment of the present invention secured to an expandable reamer housing 150 to form an intelligent expandable/retractable reamer 10. Other non-limiting embodiments of a separate modular control sub are discussed with respect to FIG. 7 and FIG. 8.

A separate modular control sub 100 may be utilized to connect to other types of mechanical tools to be controlled as discussed hereinafter. The modular control sub 100, when combined with existing commercial reamers 150, can be utilized to reduce the cost of the intelligent expandable reamer 10, the present invention. The mechanical connection 140 between the modular control sub 100 and the expandable reamer housing 150 may be threaded by standard oil field connections, bolted, and/or the like as desired. As well, it should be noted that the modular control sub 100 may be positioned above or below the reamer housing 150 as desired.

A fluid flow path 102, typically through the center of both the modular control sub 100 and reamer 150, allows the flow of drilling fluid 104 therethrough. If desired, mud signal transmitter 106 may be included to transmit data to the surface, via a mud pulse transmitter, which may or may not extend into the flow path 102 and/or may be located in separate chambers that access the flow path.

However, mud pulse transmitter 106 and/or any other types of mud pulse transmitters are not required for operation of the modular control sub 100 and may not be utilized. The modular control sub 100 can be programmed to operate independently in the active mode without the need for data signal transmission to and from the surface or to other downhole equipment such as MWD and LWD tools or other downhole tools. Moreover, it is not necessary to have wiring that extends through the modular control sub 100. In one embodiment, all electronics and wiring are contained within the modular control sub 100 without the need for wiring to extend from one end of the housing to the other. The electronic signals may be transformed utilizing actuators, without the need for wiring to leave the electronic housing 100, or extend through the modular control sub although if desired this could be done. Without the need for wiring connecting to other housings or downhole tools, reliability problems associated with any required through wiring to other downhole housings and/or transmission of information to the surface can be avoided for reduced complexity and improved reliability. However, the present invention is not intended to be limited to any particular configuration.

In this embodiment, the modular control sub 100, which may also be referred to as an electronic control housing or body or member or the like, comprises wall thickness of the control sub 108, in which may be located an electronic control unit 112, or the like within the machined side pocket(s). In one possible embodiment, access to the circuitry may be provided through a sealed plate 110 in the side of the outer wall of the modular control sub 100. The electronics control unit 112 may comprise a processor, logic circuitry, or the like to independently make decisions on whether to deploy or retract the reamer members 152. In one possible non-limiting example, the electronic control unit 112 may comprise a processor with multiple programs and/or is reprogrammable to operate any number of different tools besides a reamer. Thus, the modular control sub 100 is not limited to operation of a reamer 150.

It will be understood that reamer members 152 for use in the expandable reamer may be of many types, such as pivotally extended arms, blades, cutters, radially sliding members. The reamer may have multiple blades, cutters or other reamer members or only one member. Moreover, it will be understood that as used herein, while the plural is conveniently used herein for reamer members, as used herein the plural reamer members may also indicate only one reamer or any number of reamer members and may include centralized reamers, offset reamers, bi-centered reamers and the like. The present invention is not intended to be limited by the number of or type of reamer members. During operation of opening or closing, the reamer members or portions thereof may rotate, translate in one or multiple directions, fold, combinations of the above, and/or otherwise radially extend and retract by any desired mechanism. The amount of radially opening of the reamer members 152 may be adjustable or fixed so that the diameter of the reamed hole may be fixed or varied. The amount of opening depends on the requirements of how much the diameter of the borehole to be opened. This amount of opening may be adjustable on the surface by changing reamer components or may be downhole adjustable and/or controllable by the modular control sub with corresponding features of the reamer housing.

The electronic control unit 112 may be battery powered by lithium batteries 114 or the like and/or may be powered or recharged by downhole generators. Electronic control unit 112 may comprise a processor or the like to utilize sensor input(s) to determine when to open and close the reamers or operate other equipment as discussed hereinafter. Various sensors may be utilized to allow the electronic control unit 112 to make the required decisions. A rotation sensor 116 may be utilized that may comprise accelerometers, position sensors, magnetometers, resistivity sensors, and/or other types of sensors that may be utilized to determine position, velocity, direction of movement, rotation, RPM, in one, two or three dimensions and the like, of the modular control sub 100. Other sensors may comprise pressure internal pipe sensor(s) 118 to measure internal pipe pressure, annular pressure sensor(s) 119, and/or flow sensors of various types whether electronic or mechanical to detect fluid flow/velocity through the modular control sub 100. Annular pressure sensor 119 may be used to measure and record the information in memory. As used herein, a fluid sensor may comprise a pressure sensor, flowmeter, or other sensors that may be utilized to determine if fluid is flowing through the drill string, e.g., by measuring the fluid pressure it can be determined that the mud pump is operating and circulating fluid is flowing through the drill string. The electronic control unit 112 may comprise electronic outputs 122 to operate actuators, motors, valves, and the like. For example, in one embodiment, the electronic control unit 112 may comprise wiring to operate one or more solenoids, valves, shuttle valves, multiple position valves, electrical motors, hydraulic motors, drilling fluid motors, pistons, actuators of any type, activators, combinations thereof, and the like. For the sake of simplicity, the term for the aforementioned opening and/or closing mechanism, types of devices or the like, used herein is an actuator. As one non-limiting example of an actuator, a solenoid 120 may open and close a port 124 or valve to control the flow of drilling fluid under pressure that may, in one possible non-limiting embodiment, be utilized to direct drilling fluid 126 to hydraulically operate a spring-loaded piston to expand the reamer members 152, by shunting drilling fluid 104 to the annular space 128 and to cool and clean the cutter blocks on the reamer members.

In this embodiment, the reamer members 152 move from a closed, or retracted, position 154 inside the reamer body 160 to an open, or expanded, position 156 for reaming or opening the borehole in response to signals from the electronic control unit in modular control sub 100. If expansion is desired, the hydraulic flow may operate pistons, spring-loaded pistons connected to activation members, and/or the like to move the reamer members 152 outwardly with respect to reamer body 160 to the open position 156 and/or inwardly with respect to reamer body 160 to the closed position 154. The drilling fluid flow may be directed outside of the reamer annular body 160, as indicated at 128, cools and cleans the reamer blades once the reamer blades are opened, and also provides an indication on surface that the reamers are open as indicated by a pressure drop detectable on the surface.

The actuation of the reamer members 152 may be spring biased as indicated schematically by springs 158 to remain closed until actuated and to automatically close upon the removal of hydraulic pressure from the drilling fluid. Two or more solenoids could be utilized in modular control sub 100, with one solenoid operating a valve to hydraulically open the reamer members 152 and the other solenoid operating a valve or port to hydraulically close the reamers. Accordingly, many activation possibilities for actuators for opening and closing mechanisms for the reamers are possible in accord with the present invention. Additional possible opening and closing mechanisms for reamer 150 and/or actuators used in modular control sub 100 are discussed hereinafter in accord with other embodiments of the modular control sub 100, such as those non-limiting examples shown in FIG. 7 and FIG. 8.

It will be understood that the modular control sub 100 and reamer housing 150 could be in the same housing. However, another novel feature of one possible non-limiting embodiment of the present invention is the separation of the modular control sub 100 from the reamer housing 150 that provides manufacturing advantages in that the complexity of the reamer housing 150 is decreased. In the prior art, components that previously were discarded after use even with little wear can be reused. Therefore, the costs associated not only with manufacturing but also with operation with use of separately provided reamer housing 150 can be significantly reduced.

Figure 6:
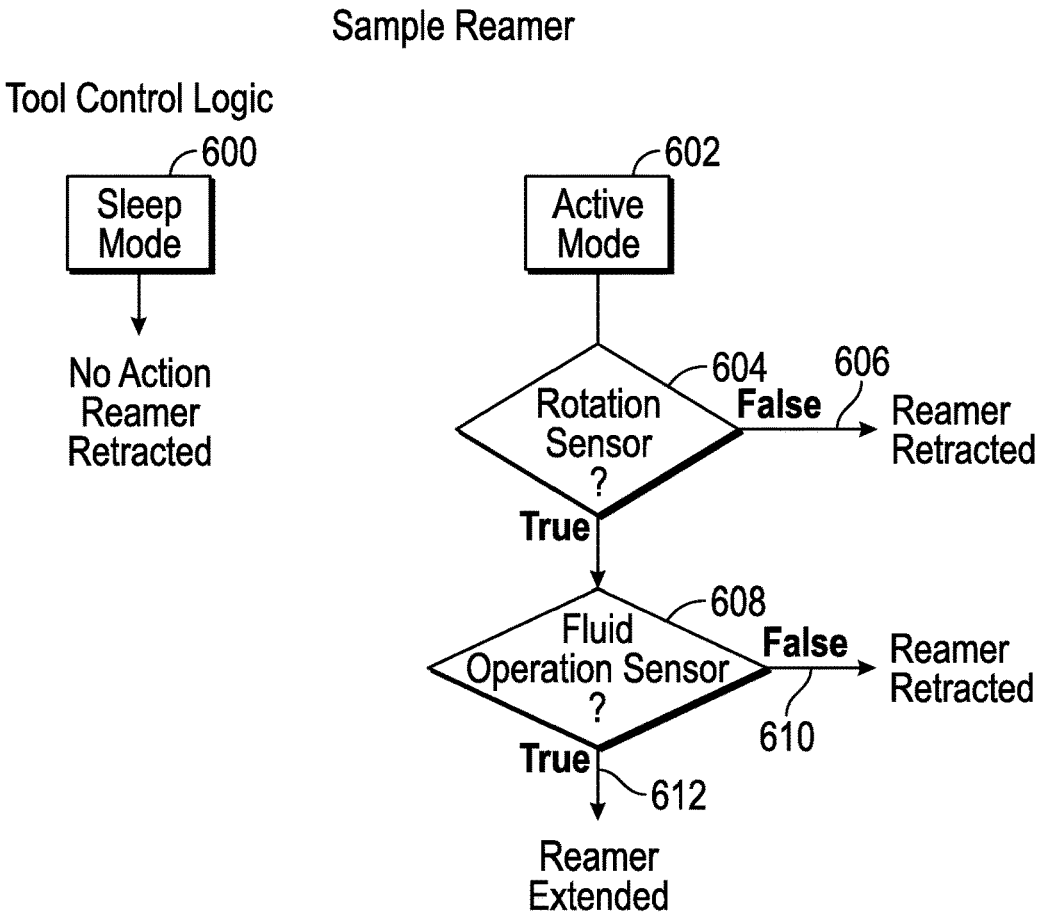
FIG. 6 is a logic flow diagram, which shows one possible example of programmable logic for processing of a control circuit in accord with one possible non-limiting embodiment of the present invention.

FIG. 6 discloses one possible non-limiting example of logic operation for a processor in the electronic control unit in the modular control sub for operation of the reamer. The processor and other circuitry in the electronic control unit can be programmed differently for operation of other tools, some non-limiting examples of which are discussed hereinafter. As used herein the term programmed could be software programming, hardwired logic, or other electronic means to implement the electronic control unit.

In one embodiment, the intelligence of the electronic control unit may comprise a sleep mode 600 and an active mode 602. In the sleep mode 600, the reamer 150 remains contracted or closed regardless of any activity detected by the sensors. This protects against inadvertent opening of the reamer member (cutter blocks) 150. By placing the tool in a sleep mode, the electronic control unit cannot open the tool at an inopportune time, which could cost the rig operator significant time and money.

When a drilling operation is to begin, such as a sliding/rotating directional drilling job, the reamer is programmed in the sleep mode 600 and is made up into the Bottom Hole Assembly (BHA) and run in the hole. Once that the reamer is in open hole, the electronic control unit 112 in the modular control sub 100 can be cycled into the active mode 602 by down link commands. The present invention is not limited to sliding/rotating directional drilling jobs and may be utilized with other drilling jobs such as conventional rotary drilling, coiled tubing drilling, rotary steerable systems and the like. In this example, once in the active mode, the electronic housing 100 is capable of independently distinguishing between sliding drilling and rotating drilling without concerns about operations that could otherwise confuse prior art tools or their personnel operators.

Accordingly, in one non-limiting embodiment, once that the electronic control unit 112 has been activated by down link, the electronic control unit 112 automatically closes the reamers members for sliding drilling and automatically opens the reamer members for rotating drilling, without further need for additional down links from the surface. The tool is therefore much more quickly responsive to changes in sliding drilling and rotating drilling without the delays associated with repeated down linking. Unlike prior art devices, the intelligent controller is highly suitable for frequent changes in rotating/sliding drilling.

Figure 5:
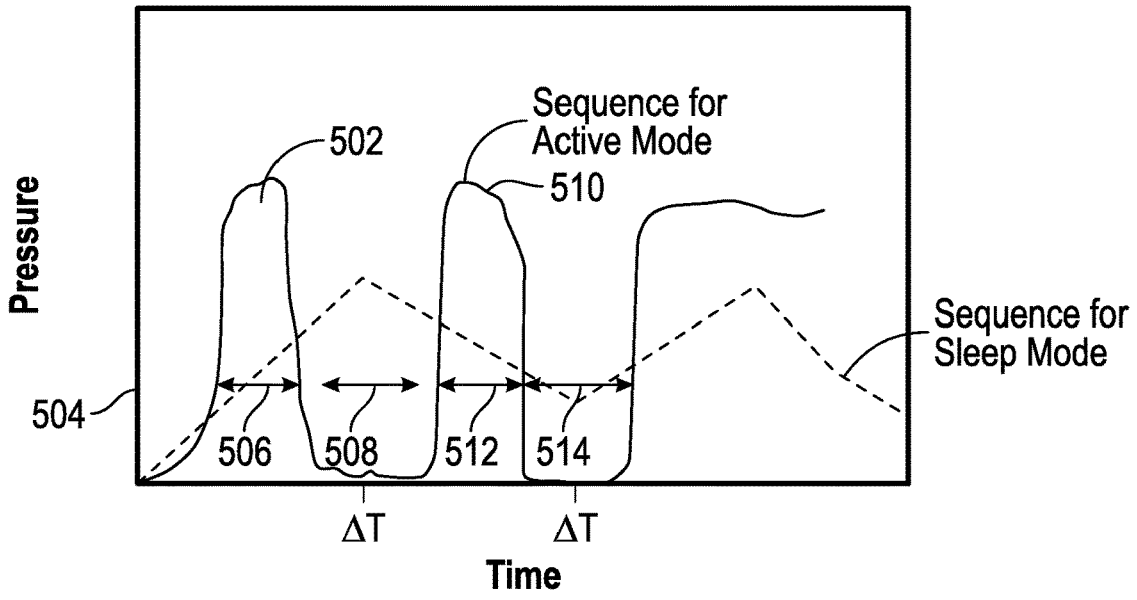
FIG. 5 is a schematic view of one possible non-limiting sequence of pressure or flow control for switching (down linking) to the electronic control unit, located in the modular control sub of FIG. 4 between an active mode and a sleep mode in accord with one possible non-limiting embodiment of the present invention.

In order to place the modular control sub 100 in active mode from sleep mode, different techniques may be utilized—one non-limiting example is shown in FIG. 5, is the down linking. For this example, an internal drill pipe pressure sensor 118, in conjunction with the electronic control unit 112, as shown in FIG. 4, may be utilized to detect a programmed sequence of circulating pressure vs. time, which may be produced by the cycling of the mud pump or other action at the surface (down link). In this example, FIG. 5, the circulating pressure 502 exceeds a minimum pressure threshold 504 for specified time duration 506 and the pressure is returned to zero for specified time duration 508. The circulating pressure increases 510 once again from zero to 510—for a specified time duration 512 and then back to zero for specified time duration 514, which the processor in the electronic control unit 112 will acknowledge as a down-link command and will switch from what may be referred to as a second mode (sleep mode) to what may be referred to as a first mode (activate mode). To place the tool in second mode (sleep mode) again, another pressure vs. time pattern (down link) may be utilized as indicated in FIG. 5. It will be appreciated that any number of changes between sleeping mode and active mode may be utilized.

Other non-limiting means for changing the mode from sleep mode to active mode and/or back may be utilized in other embodiments. For example, a series of rotation patterns of the drill string, within a specified rotary speed range, over a specified timeframe may be utilized. Or combinations of any of the above or below techniques may be utilized as well as other techniques. For example, down links may be sent from the surface to place the tool in the active mode or sleep mode. In another embodiment, a timer may be utilized. Combinations of the above techniques or other techniques may be utilized to control the active and sleep modes. As noted, techniques described herein merely as examples and other techniques may be utilized. Accordingly, many different methods may be utilized to transfer between sleep mode and active mode may be utilized. In another embodiment, if desired, a third mode switch could be utilized to keep the reamer in the extended position regardless of sensors until switched out of that mode by any of the above or other methods.

As noted above, after placement in active mode, the electronic control unit 112 in the modular control sub 100 can be used in one possible non-limiting example to quickly and automatically switch between sliding drilling and rotary drilling without the need for additional surface signals, dropped balls, telemetry or the like as per the prior art.

After the electronic control unit 112 has been placed into the Active Mode 602 (FIG. 6) a possible series of logic tests 604 and 608 are utilized to determine whether the drilling is rotating drilling or sliding drilling. Although testing for rotation 604 is shown first, the fluid operation sensor 608 may be tested first with rotation 604 tested second or the sensors may be tested simultaneously or near simultaneously with the electronics of the tool.

For example, the rotation sensor 116 can be tested for rotation drilling by the processor in the electronic control unit 112 as indicated at 604. In one possible non-limiting embodiment, if the processor interprets the sensor readings as not indicating rotation (as discussed further in regard to FIG. 6A), so as to provide a logic false answer as indicated at 606, then the electronic control unit 112 in the modular control sub 100 will keep the reamer arms in the closed position. In other words, the electronic control unit distinguishes sliding drilling from rotating drilling or at least the absence of rotating drilling. In the event that the reamer member(s) were previously extended or opened, then the reamer member(s) will automatically be retracted to the closed position. If the test for rotation is true, then in one possible non-limiting embodiment, additional logic tests may need to be satisfied before the electronic control unit 112 indicates rotating drilling. In this example, a fluid operation test 608 could be utilized. Fluid operation may involve drilling mud fluid flow, well bore circulation, fluid pressures such as internal pipe pressure detected by the electronic control unit 112 or the like. In this example, if a logic test 608 indicates insufficient fluid operation such as flow, pressure, time periods, and/or combinations of these, or the like is not detected as interpreted by the processor in the electronic control unit 112 in the intelligent reamer 10, then the reamer will keep the reamer members in the retracted position—or if the reamer members are already in the open position, then the reamer members are moved to the retracted position as indicated at 610.

In this non-limiting example, only if the electronic processor for the electronic control unit 112 interprets sensor readings to indicate both rotation and fluid operation as being true as indicated at 612, then the reamer members are extended. Accordingly, the present invention avoids prior art problems associated with inadvertent opening of the reamers.

In other words, in the active mode 602, electronic control unit 112 is programmed for evaluating a signal from at least one motion sensor, e.g. a rotation sensor, to distinguish between rotating drilling and sliding drilling. Additional sensors such as a fluid operation sensor may also be utilized in one possible preferred embodiment to distinguish between rotating drilling and sliding drilling, The electronic control unit 112 is further operable to effect movement of the reamer members to the expanded position during the rotating drilling and to move the reamer members to the retracted position during the sliding drilling.

It will be appreciated that many different variations of this logic may be utilized. For example, operation may be based on accelerometer, magnetometer, or other sensor readings that indicate whether the tool is being used for sliding drilling (little or no rotation of the drill string) or rotation drilling (the entire drill string is rotating).

Figure 6A:
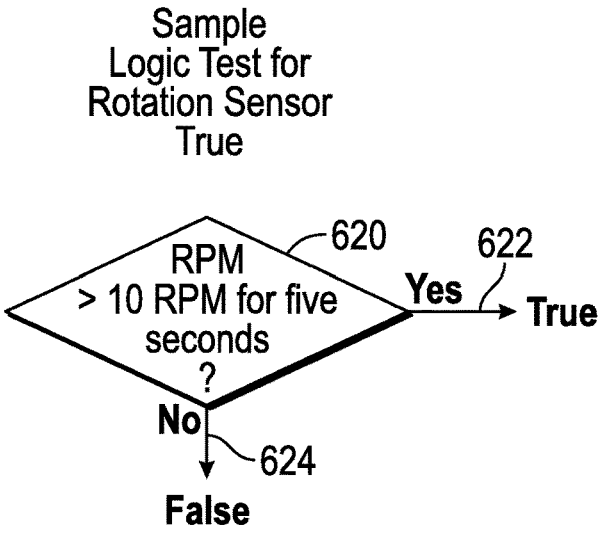
FIG. 6A is a logic flow diagram for testing rotation in programmable logic in accord with one possible non-limiting embodiment of the present invention.

FIG. 6A shows one possible test 620 for determining whether rotation is occurring as compared to temporary rotation during orientation for sliding drilling, slip stick during sliding drilling, drill string wind up, reactive torque from the mud motor, or the like. In this non-limiting example, rotation is tested for full rotations of the drill string at rotation speeds greater than 10 RPM for at least 5 seconds. Other RPMs and/or times may be utilized. Other tests may comprise testing for relatively constant rotation speeds, higher rotation speeds, or the like. If the test indicates rotation of the drill string, then that aspect of the logic requirements is then satisfied as indicated at 622 and cutter blocks are deployed. Otherwise the result is no rotation as indicated at 624 and cutter blocks remain retracted. It will be appreciated that in the absence of rotation, in one possible non-limiting example, the reamer members 152 are always closed, or are automatically moved from the open position to the closed position during sliding drilling. Accordingly, a number of tests may be made by the electronic control unit to verify and distinguish rotating drilling from sliding drilling in a conservative, safe, and yet relatively quick manner.

Various types of similar tests may be utilized for the fluid operation sensor such as a selected value of pressure or range of pressure values/flow rates that remains above a minimum pressure above hydrostatic pressure and or a minimum flow rate for a selected time period, e.g. for five seconds. However, the intelligent reamer control of one embodiment of the present invention is not limited to use of any particular flow tests or multiple flow tests. Accordingly, in one possible non-limiting embodiment could be operated by appropriate rotation detectors as described above.

Figure 7:
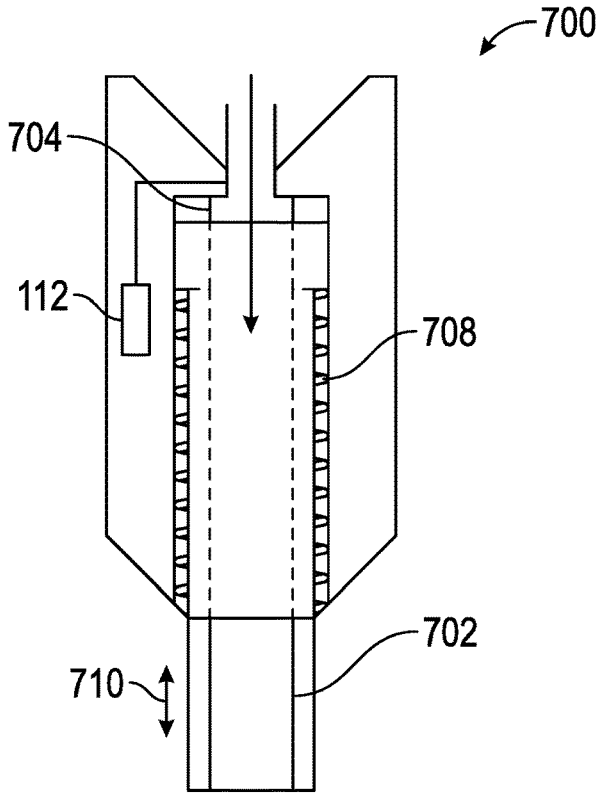
FIG. 7 is an elevational diagrammatic view of a modular control sub in accord with one possible non-limiting embodiment of the present invention.
Figure 8:
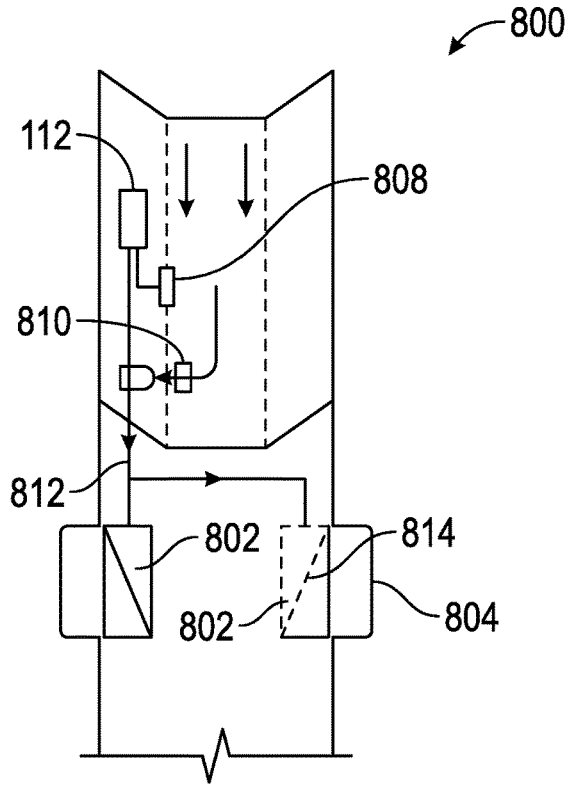
FIG. 8 is an elevational diagrammatic view of a modular control sub in accord with one possible non-limiting embodiment of the present invention.

FIG. 7 and FIG. 8 are provided to show that modular control sub 100 can be implemented in a number of different ways. FIG. 7 shows a non-limiting different embodiment wherein the original design modular control sub 100 is modified, modular control sub 700 that may utilize a spring-loaded and/or hydraulically operated piston to activate reamer members 152 instead of directing fluid flow to the reamer housing 150 as discussed previously in connection with modular control sub 100. Piston 702 moves upwardly and downwardly as indicated by arrow 710. In this embodiment, one or more valves 704, solenoids, or the like, controlled by electronic control unit 112 may be utilized to activate the piston 702 or rods or other components to connect with activation means in the reamer housing 150 or other types of housings discussed hereinafter. FIG. 7 is shown simply as an example of piston operated mechanism and is not intended to be a manufacturing level design or show other working components in any detail. For example, when it is desired to open the reamers, valve 704 opens a port that moves piston 702 downwardly and then closes to lock the piston 702 in the extended position as shown. Piston 702 engages a reciprocal opening and closing mechanism in the reamer housing 150 to open the reamers. When it is desired to retract the reamers, valve 704 or another valve is opened to release pressure off the piston so that spring 708 retracts piston 702 and also the reamers. Accordingly, the logic of FIG. 5 and FIG. 6 can be implemented with a different embodiment the modular control sub.

FIG. 8 shows another varied embodiment wherein the original design modular control sub 100 is modified to modular control sub 800 comprises hydraulically driven wedge elements 802 that may be utilized to wedge open the reamer members 804. The opening and closing mechanism for the reamer members 804 may be spring loaded to return to position. In this example, electronic control unit 112 and sensor 808 may be used for control purposes in conjunction with the operation logic discussed above. When desired to extend the reamers 804, valve 810 directs fluid through fluid path 812 for wedge activation of the reamer members 804 using wedge elements 802 wedging surface 814 between reamer members 804 and wedge elements 802.

In other embodiments of modular control subs, fluid driven rotary motors positioned in the modular control sub and/or reamer may be utilized for activation and/or electrical motors may be utilized. Accordingly, many different types of activation systems may be operated by the modular control sub 100 in accord with the present invention to operate many types of opening and closing mechanisms for the reamers.

Figure 9A:
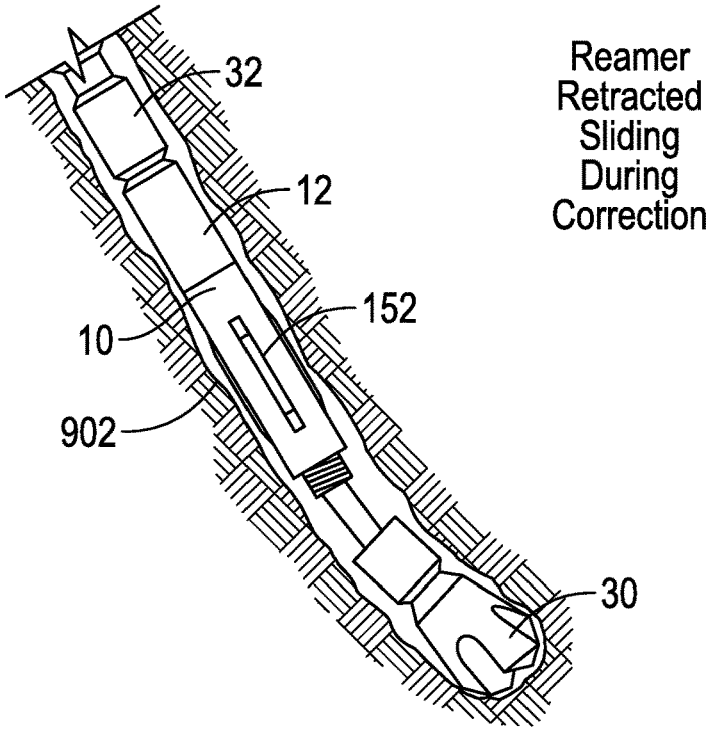
FIG. 9A is a diagrammatic view of a bottom hole assembly with a reamer member or members retracted with respect to a reamer body section while drilling a borehole, while utilizing only sliding drilling with an expandable reamer contracted in accord with one possible non-limiting embodiment of the present invention.

FIG. 9A, FIG. 9B, FIGS. 9C, and 9D show non-limiting embodiments of various effects of sliding drilling and reaming in accord with the present invention. For convenience, it will be presumed that a suitable downhole configuration such as that shown in FIG. 1 is conceptually shown in this series of figures. FIG. 9A is representative of rotating drilling when the intelligent reamer is placed in the sleep mode—and the reamer members remain contracted or closed, whereby the wellbore 902 is approximately the same diameter of the bit 30. FIG. 9A could also represent the wellbore 902 created during sliding drilling with a mud motor, when the electronics control unit 112 is in the active mode and the drill string 32 is not rotating. When sliding drilling, in the active mode, the reamer members 152 are retracted due to lack of rotation as discussed previously and the wellbore 902 is approximately the same diameter of the bit 30. However, with rotating/sliding drilling operations, changes between rotating and sliding, and the like, may cause ledges, doglegs and discontinuities in the wellbore shape that may be undesirable, such as for running casing and tripping in and out of the hole. Use of the combination of the intelligent reamer 10 provides a novel way to remove such discontinuities with a minimum wasted time and effort.

Figure 9B:
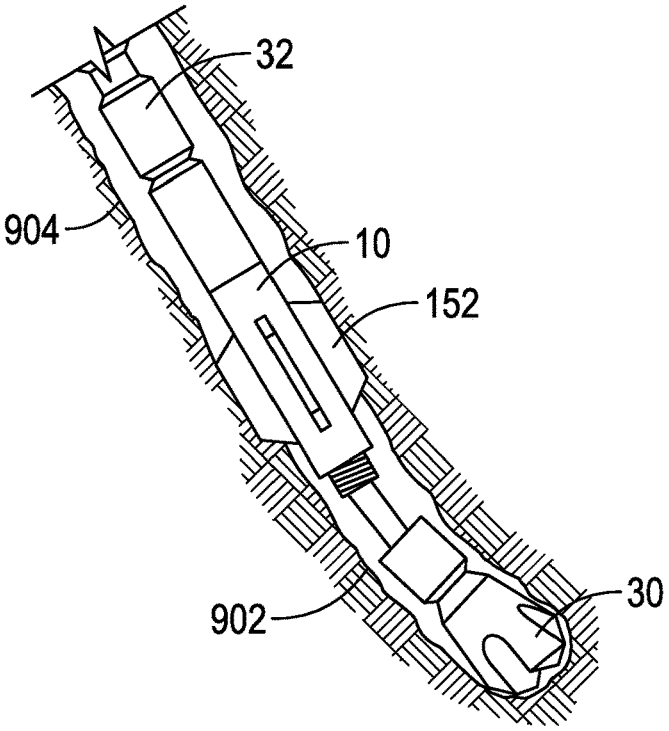
FIG. 9B is a diagrammatic view of a bottom hole assembly with one or more reamer members expanded from a reamer body section while utilizing downwardly directed rotating drilling with an expandable reamer in accord with one possible non-limiting embodiment of the present invention.

FIG. 9B could be representative of the effect of enlarging the wellbore when the drill string 32 is rotated and then reaming while rotating upwardly or downwardly to enlarge the bore as indicated at 904. The present invention readily extends reamer blades 152 as discussed previously in response to logic and control mechanisms in the intelligent reamer 10. The wellbore 902 below the intelligent underreamer 10 is approximately the same diameter of the bit 30 and the underreamed wellbore 904 is enlarged. FIG. 9B might also be representative of rotating drilling while backreaming upwardly and then moving the drill string 32 to the bottom of the wellbore.

Figure 9C:
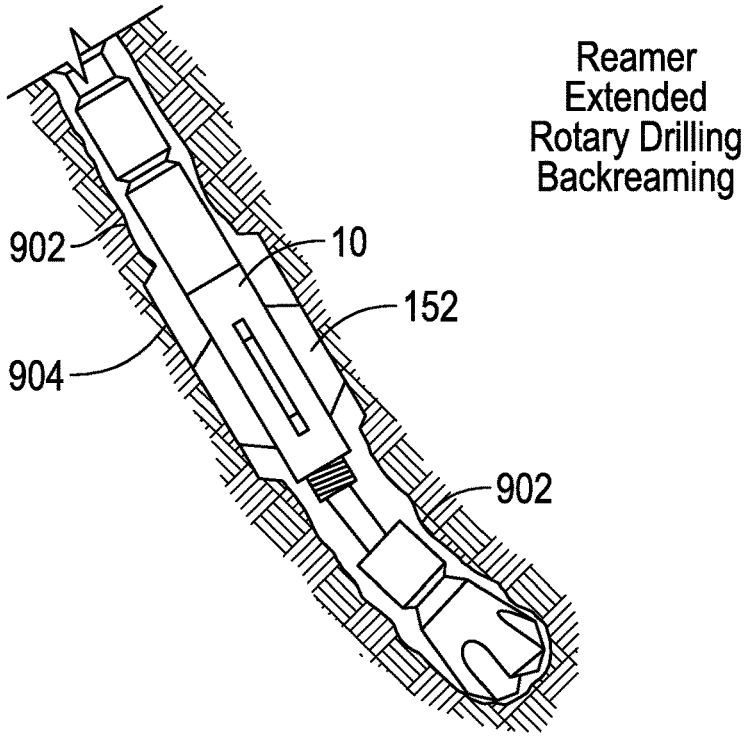
FIG. 9C is a diagrammatic view of a bottom hole assembly utilizing downwardly and upwardly (backreaming) directed rotating drilling with an expandable intelligent reamer in accord with one possible non-limiting embodiment of the present invention.

FIG. 9C shows the effect of rotating drilling and moving the drill stream upwardly and/or downwardly thereby conveniently creating an enlarged pocket 904 in the wellbore as may be desirable for a production zone that is to be gravel packed. The smaller bit sized bore 902 appears above and below the enlarged pocket 904.

Figure 9D:
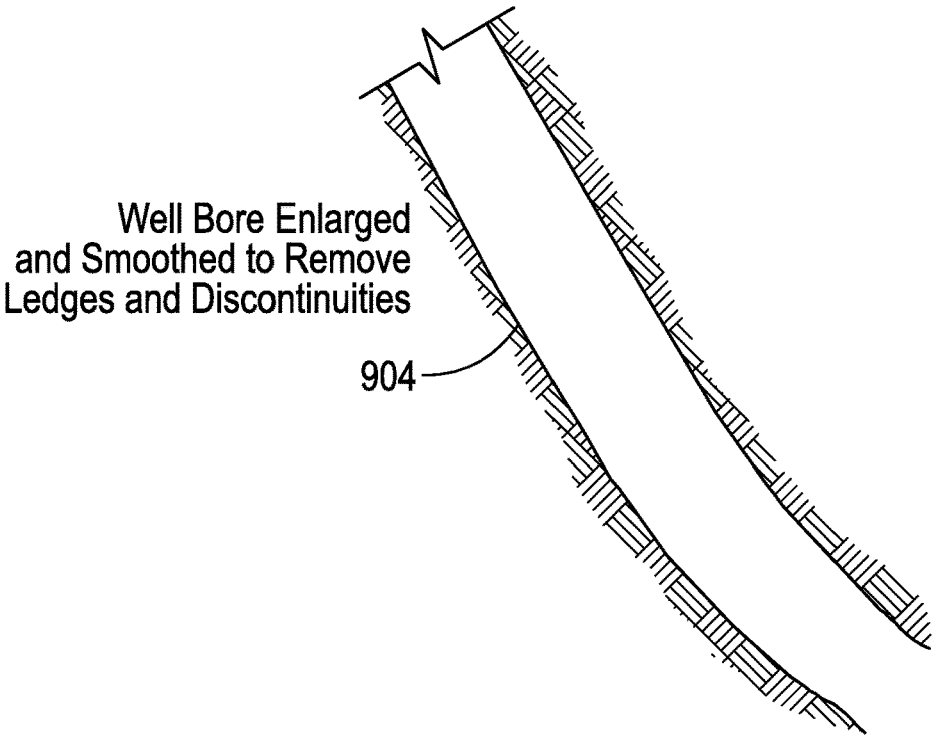
FIG. 9D is a diagrammatic view of a well bore that has been enlarged and smoothed to remove ledges, reducing the severity of doglegs and discontinuities in accord with one possible non-limiting embodiment of the present invention.

FIG. 9D shows the effect of an enlarged reamed wellbore 904 where the wellbore is smoothed out at the desired diameter, removing ledges, doglegs and discontinuities and the like, that may be caused during drilling in accord with another novel feature of the present invention.

While the modular control sub 100 may be utilized to operate a reamer, the device may also be connected to and utilized with many other tools. As discussed above, modular control sub 100 can be a separate housing that can be attached to various tools. The following are non-limiting examples of a family of tools that can be connected to the modular control sub 100 to perform other services.

Figure 10A:
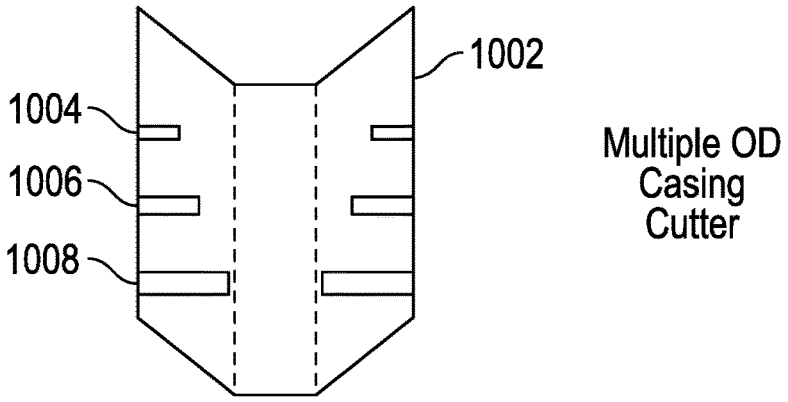
FIG. 10A is a diagrammatic elevational view of an extendable/contractible multiple outer diameter casing cutter that may be connected to a programmable electronic control unit, which may be in accord with separately attachable modular control sub of FIG. 4, FIG. 7, and/or FIG. 8 in accord with one possible non-limiting embodiment of the present invention.

In FIG. 10A, there is shown a multiple OD casing cutter tool 1002 that may be utilized to cut through multiple different strings of casing having different diameters without the need to change out tools. In this example, three different cutting blades 1004, 1006, and 1008 are shown that may be sequentially operated by the control sub. Various types of actuators may be utilized and the modular control sub 100 may be utilized to select the cutting blade desired. For example, three solenoids or a three position solenoid may be utilized to activate three different mechanisms. Alternatively a shuttle valve with multiple outlets may be operated with a single solenoid. In another embodiment, a single blade or group of blades may be piston operated to pivotally open to the desired depth and continually opened further as needed.

Figure 10B:
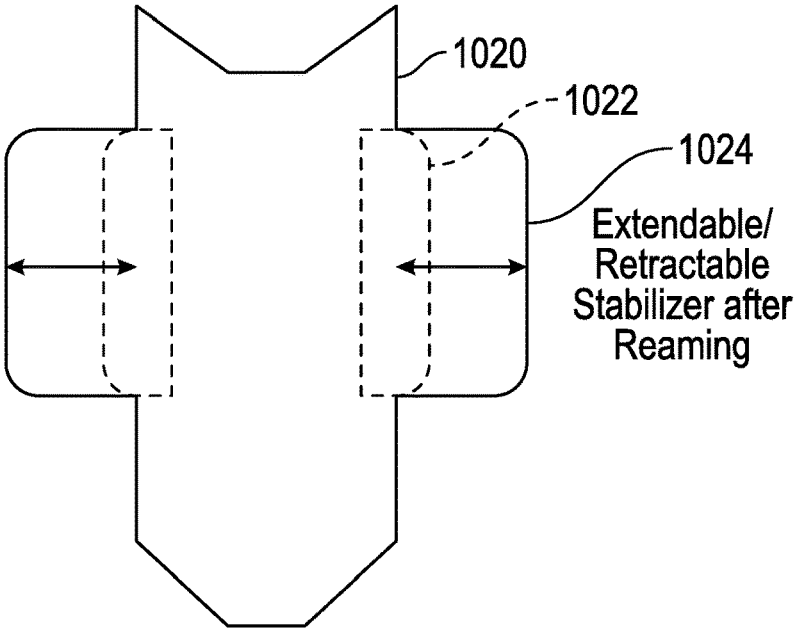
FIG. 10B shows a diagrammatic elevational view for one embodiment of an extendable/retractable stabilizer tool used after reaming a larger borehole that may be connected to a programmable electronic control unit, which may be in accord with separately attachable modular control sub of FIG. 4, FIG. 7, and/or FIG. 8 in accord with one possible non-limiting embodiment of the present invention.

FIG. 10B shows an extendable/retractable stabilizer. The stabilizer may be used for centralizing the drill string once the bore hole has been enlarged. The stabilizer may comprise expandable members that may translate or hingably move outwardly. Prior to enlargement of the borehole, stabilizers may be retracted as indicated at 1022. After reaming, the stabilizers may extend radially axially outwardly as indicated at 1024. Thus, various types of extendable members may be utilized, which if desired may also be retractable. The members may be spring loaded, hydraulic, comprise mechanical linkage, be electrically operated and/or any combination of thereof in response to actuators in the modular control sub 100.

Figure 10C:
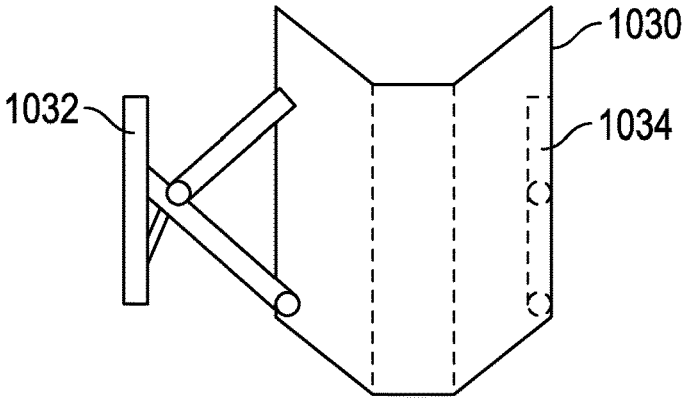
FIG. 10C shows a diagrammatic elevational view for another embodiment of an extendable/retractable stabilizer tool used after reaming a larger borehole that may be connected to a programmable electronic control unit, which may be in accord with separately attachable modular control sub of FIG. 4, FIG. 7, and/or FIG. 8 in accord with one possible non-limiting embodiment of the present invention.

FIG. 10C shows another type of expandable stabilizer 1030 with arm 1032 in the expanded position and 1034 in the retracted position. In this embodiment, the arms move outwardly with a pivotal mechanism and may be spring loaded.

Figure 10D:
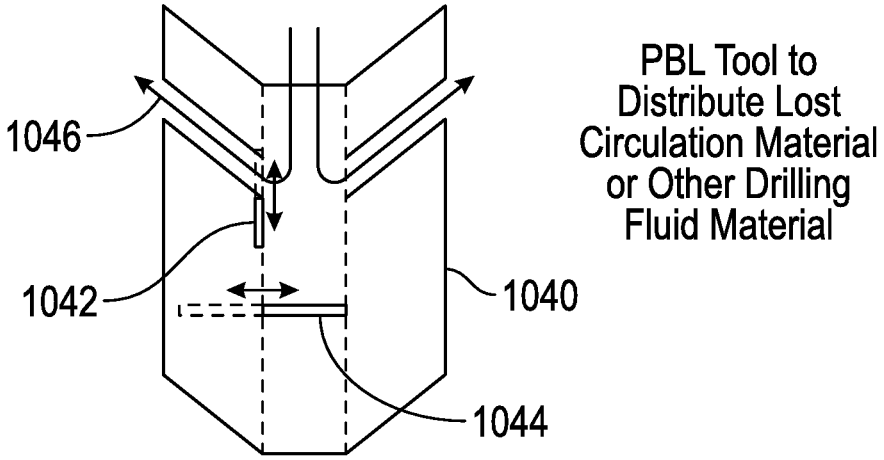
FIG. 10D is a diagrammatic elevational view of a Drilling Circulating Sub that may be utilized with a programmable electronic control unit, which may be in accord with separately attachable modular control sub of FIG. 4, FIG. 7, and/or FIG. 8 in accord with one possible non-limiting embodiment of the present invention.

FIG. 10D shows a drilling circulating sub tool 1040 that may be utilized to distribute lost circulation material from the inner flow path through the drill string to the borehole or annulus outside the drillstring. In many cases, lost circulation material is used to heal, or seal the wall cake of the wellbore, to prevent further loss of drilling fluid into the formation, For example, rubber sponge material, peanut hulls, fibrous material and the like may be circulated to the annulus to remedy lost circulation. Accordingly, a drilling circulating sub tool may comprise valves or closure members 1042 that open to the wellbore to distribute the material into the wellbore. Once the closure member opens, then the lost circulation material is directed outside the tool to the annulus as indicated at 1046. As well, the tool may comprise a closure member 1044 or valve to prevent the material from flowing downwardly into the mud motor and the bit. The drilling circulating sub tool may be operated or actuated by hydraulic lines or the like from electronic control sub as discussed hereinbefore. The closure members 1042 and 1044 may be operated separately or simultaneously.

Figure 10E:
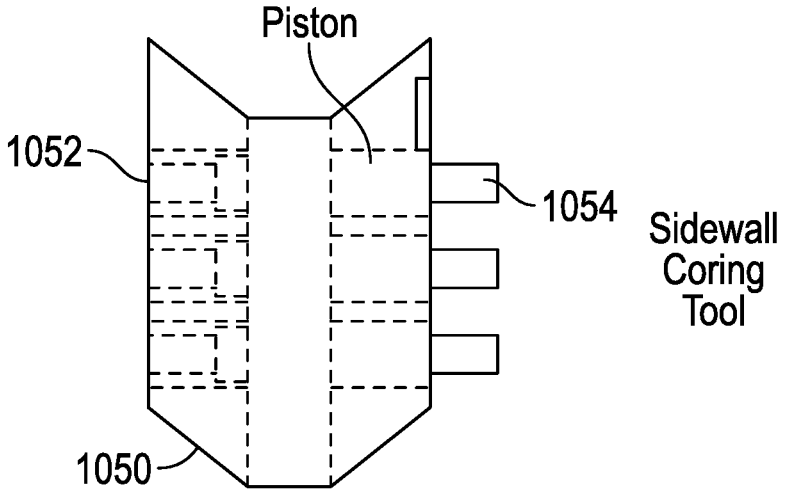
FIG. 10E is a diagrammatic elevational view of a sidewall coring tool that may be utilized with a programmable and/or electronic control unit, which may be in accord with separately attachable modular control sub of FIG. 4, FIG. 7, and/or FIG. 8 in accord with one possible non-limiting embodiment of the present invention.

FIG. 10E shows a sidewall coring tool 1050 that may be utilized to retrieve cores from the borehole. For example, the drilling fluid may be directed to operate high speed hydraulic motors or drills 1054 which are hydraulically pressed into the formation utilizing a piston 1052 and then withdrawn hydraulically by reversing the force on the piston. A piston may be utilized to press the tool against the formation. If desired a sealable cover may be utilized to protect the core from damage as it is withdrawn. Prior art rotary sidewall coring tools, such as those run by wireline, are often limited in the rotary cutting power. However, drilling fluid may be pumped and directed at high pressure and power to hydraulically powered high speed rotary motors. The modular control sub 100 may be utilized to selectively operate each coring mechanism, for example with a shuttle valve to shift hydraulic fluid consecutively to each rotary motor, or the use of a single motor and separate storage containers to obtain quality cores at a greatly reduced cost and time as compared to standard coring or to obtain cores where coring was not utilized.

While the present invention may include a separate modular control sub for the reamer or other tools, it will be understood that the electronic circuitry may be utilized to operate various tools that presently are purely mechanically operated and may be difficult to control from the surface.

Accordingly, the present invention provides a modular control sub with circuitry and actuators that may be utilized to operate a reamer or other tools.

In one method of operation, the present invention may be utilized for drilling a well bore utilizing a combination of sliding drilling and rotating drilling. The method may comprise placing drill bit on drill string, with the drill bit comprising a bit outer diameter. A mud motor is utilized on the drill string with an intelligent expandable reamer control. The reamer is moveable from a closed position to an open position wherein in said open position said reamer is operable for reaming said drill string to enlarge said well bore to a diameter larger than said bit outer diameter. The intelligent reamer is operable to distinguish mud flow and rotation of the drill bit that may occur without need to open the reamer. The method may comprise alternately sliding drilling and rotating drilling whereby the intelligent reamer control detects sliding drilling whereupon said reamer control operates said reamer to move said reamer members to said closed position and whereby said reamer control detects rotating drilling whereby said reamer control operates said reamer to move said reamer members to said open position to enlarge said well bore.

Many additional changes in the details, components, steps, and organization of the system and method, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. An electronic extendable member apparatus for a downhole drilling assembly, comprising:

a tool body connectable to said downhole drilling assembly;

one or more members that are movable with respect to said tool body between an extended position and a retracted position;

an electronic control unit mounted in said downhole drilling assembly programmed for moving said one or more members between said first position and said second position a plurality of times; and a sensor mounted in said downhole drilling assembly to detect rotation, said electronic control unit being programmed for evaluating a signal from said sensor to distinguish between rotating drilling and sliding drilling, said electronic control unit being programmed to move said one or more members to said extended position during said rotating drilling and to move said one or more members to said retracted position during said sliding drilling.

2. The electronic extendable member apparatus of claim 1, further comprising that said electronic control unit is programmed to be selectively controllable with a surface control to change between a first mode and a second mode a plurality of times, whereby in said first mode said electronic control unit is programmed for utilizing said signal for distinguishing between said rotating drilling and said sliding drilling without requiring use of said surface control and whereby in said second mode said electronic control unit maintains said one or more members in said retracted position regardless of said rotating drilling or said sliding drilling.

3. The electronic extendable member apparatus of claim 1 wherein said electronic control unit is mounted within at least one of said tool body or an electronic control housing.

4. The electronic extendable member apparatus for a downhole drilling assembly of claim 1, wherein said tool body comprises a threaded connection connectable to at least one of a multiple diameter casing cutter, an extendable stabilizer, a drilling circulating sub operable to bypass lost circulation material to an annulus of a borehole, or a sidewall coring tool, said electronic control unit being programmable to control operation of at least one of said multiple diameter casing cutter, said extendable stabilizer, said drilling circulating sub or said sidewall coring tool.

5. A method for making or using an electronic member apparatus, said electronic member apparatus being connectable to a downhole drilling assembly for use downhole, said method comprising:

providing a tool body connectable to said downhole drilling assembly;

mounting one or more members that are movable with respect to said tool body between an extended position and a retracted position;

providing an electronic control unit in said downhole drilling assembly, programming said electronic control unit for moving said one or more members between said extended position and said retracted position a plurality of times; and providing a sensor in said downhole drilling assembly to detect rotation, programming said electronic control unit for evaluating a signal from said sensor to distinguish between rotating drilling and sliding drilling, programming said electronic control unit to move said one or more members to said extended position during said rotating drilling and to move said one or more members to said retracted position during said sliding drilling.

6. The method for making or using an electronic member apparatus of claim 5, further comprising programming said electronic control unit to be selectively controllable with a surface control to change between a first mode and a second mode a plurality of times, programming said electronic control unit in said first mode for utilizing said signal for distinguishing between said rotating drilling and said sliding drilling without requiring use of said surface control and programming said electronic control unit in said second mode maintains said one or more members in said retracted position regardless of said rotating drilling or said sliding drilling.

7. The method for making or using an electronic member apparatus of claim 5, further providing mounting said electronic control unit within at least one of said tool body or an electronic control housing.

8. An electronic extendable member apparatus for a downhole drilling assembly, comprising:

a tool body connectable to said downhole drilling assembly;

one or more members mounted to said tool body that are movable between a first position and a second position;

an electronic control unit mounted in said downhole drilling assembly programmed for moving said one or more members between said first position and said second position a plurality of times; and a sensor mounted in said downhole drilling assembly to detect rotation, said electronic control unit being programmed for evaluating a signal from said sensor to distinguish between rotating drilling and sliding drilling, said electronic control unit being programmed to move said one or more members to said first position during said rotating drilling and to move said one or more members to said second position during said sliding drilling.

9. The electronic extendable member apparatus of claim 8, further comprising that said electronic control unit is programmed to be selectively controllable with a surface control to change between a first mode and a second mode a plurality of times, whereby in said first mode said electronic control unit is programmed for utilizing said signal for distinguishing between said rotating drilling and said sliding drilling without requiring use of said surface control and whereby in said second mode said electronic control unit maintains said one or more members in said second position regardless of said rotating drilling or said sliding drilling.

10. The electronic extendable member apparatus of claim 8 wherein said electronic control unit is mounted within at least one of said tool body or an electronic control housing.

* * * * *